US009376981B2

(12) United States Patent
Nagumo et al.

(10) Patent No.: US 9,376,981 B2
(45) Date of Patent: Jun. 28, 2016

(54) INSTANTANEOUS FUEL CONSUMPTION DISPLAYING DEVICE FOR VEHICLE

(75) Inventors: Takamasa Nagumo, Wako (JP); Yoshiaki Hirakata, Wako (JP); Ryohei Kitamura, Wako (JP); Takeshi Kitajima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 833 days.

(21) Appl. No.: 13/544,400

(22) Filed: Jul. 9, 2012

(65) Prior Publication Data

US 2013/0054118 A1 Feb. 28, 2013

(30) Foreign Application Priority Data

Aug. 29, 2011 (JP) ..... 2011-185633

(51) Int. Cl.
*F02D 41/30* (2006.01)

(52) U.S. Cl.
CPC .... *F02D 41/3005* (2013.01); *F02D 2200/0625* (2013.01)

(58) Field of Classification Search
None
See application file for complete search history.

(56) References Cited

U.S. PATENT DOCUMENTS

| | | | | | |
|---|---|---|---|---|---|
| 3,967,097 | A * | 6/1976 | Moretti | 701/123 | |
| 4,054,781 | A * | 10/1977 | Kuno | G01F 9/023 701/123 | |
| 4,217,644 | A * | 8/1980 | Kato | G01F 23/68 377/21 | |
| 4,400,779 | A * | 8/1983 | Kosuge et al. | 701/123 | |
| 4,488,236 | A * | 12/1984 | Morrison et al. | 701/123 | |
| 4,706,083 | A * | 11/1987 | Baatz et al. | 701/123 | |
| 4,845,630 | A * | 7/1989 | Stephens | 701/123 | |
| 7,028,561 | B2 * | 4/2006 | Robertson | B67D 7/085 222/52 | |
| 7,158,866 | B2 * | 1/2007 | Gustafsson | B60C 23/061 701/1 | |
| 7,680,564 | B2 * | 3/2010 | Kawamura | B62J 6/18 307/10.1 | |
| 7,772,970 | B2 * | 8/2010 | Masuda | F02D 11/105 340/438 | |
| 8,655,527 | B2 * | 2/2014 | Harumoto | B60K 6/48 180/65.21 | |
| 2008/0178839 | A1 * | 7/2008 | Oshima | F02D 31/002 123/339.2 | |
| 2008/0195302 | A1 * | 8/2008 | Guzman | B60W 30/143 701/123 | |
| 2009/0326777 | A1 * | 12/2009 | Oshima et al. | 701/83 | |

FOREIGN PATENT DOCUMENTS

| | | | |
|---|---|---|---|
| JP | 55-80718 | A | 6/1980 |
| JP | 61-198287 | A | 9/1986 |
| JP | 63-025517 | A | 2/1988 |
| JP | 11-022539 | A | 1/1999 |
| JP | 2008-183972 | A | 8/2008 |
| JP | 2008-267334 | A | 11/2008 |

* cited by examiner

*Primary Examiner* — Lindsay Low
*Assistant Examiner* — Brian P Monahon
(74) *Attorney, Agent, or Firm* — Birch, Stewart, Kolasch & Birch, LLP

(57) ABSTRACT

An injection valve injects a given amount of fuel into an engine in response to an injection pulse. An ECU inputs the injection pulse corresponding to an amount of injected fuel. The ECU inputs information on an amount of injected fuel corresponding to the number of injection pulses to a display controlling portion through a communication line. The ECU produces the information on the amount of injected fuel composed of digital data whenever a given number of injection pulses corresponds to the given amount of fuel. The display controlling portion decides that the given amount of fuel is injected from the injection valve when a predetermined number of pieces of digital data are properly received. The display controlling portion calculates an instantaneous fuel consumption based on an amount of injected fuel thus decided and an operating distance to cause a meter to display information on the instantaneous fuel consumption.

17 Claims, 10 Drawing Sheets

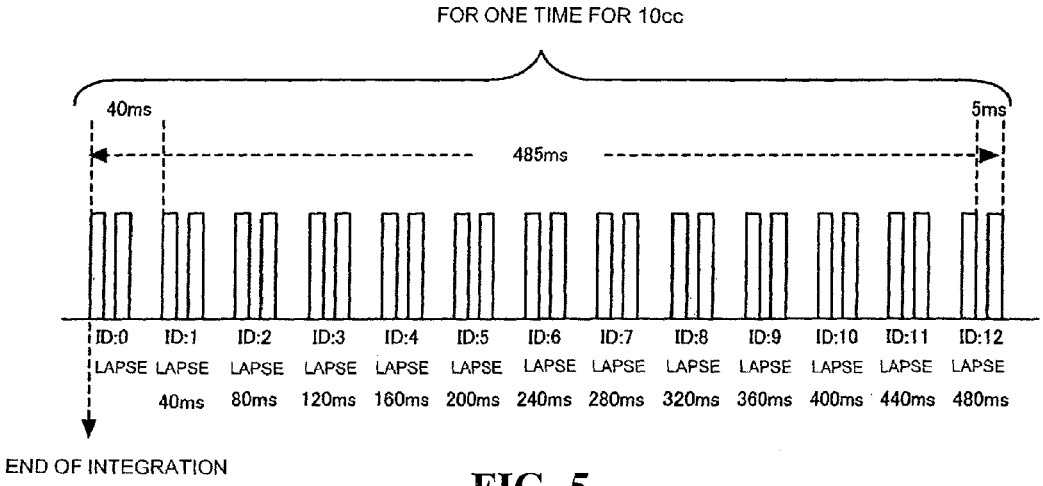
FIG. 5
※ EXPLANATION OF ID
| | | | |
|---|---|---|---|
| ID:0 | 10000 | ID:7 | 10111 |
| ID:1 | 10001 | ID:8 | 11000 |
| ID:2 | 10010 | ID:9 | 11001 |
| ID:3 | 10011 | ID:10 | 11010 |
| ID:4 | 10100 | ID:11 | 11011 |
| ID:5 | 10101 | ID:12 | 11100 |
| ID:6 | 10110 | | |
FIG. 6
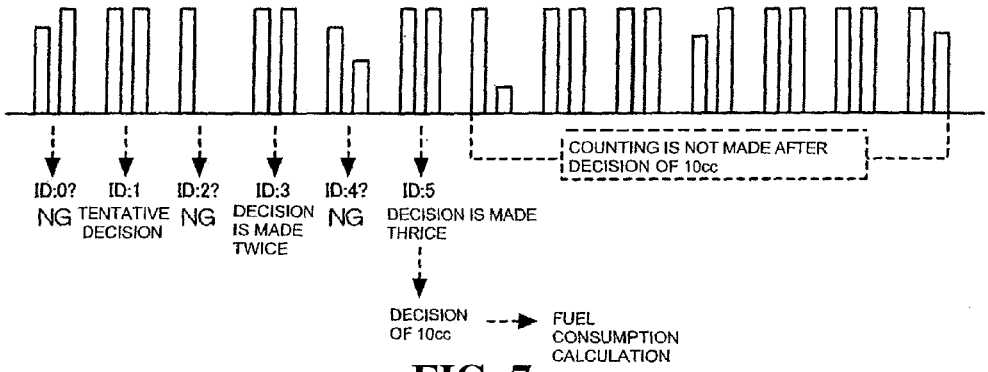
FIG. 7

INSTANTANEOUS FUEL CONSUMPTION DISPLAYING DEVICE FOR VEHICLE

CROSS-REFERENCE TO RELATED APPLICATIONS

The present application claims priority under 35 USC 119 to Japanese Patent Application No. 2011-185633 filed Aug. 29, 2011 the entire contents of which are hereby incorporated by reference.

BACKGROUND OF THE INVENTION

1. Field of the Invention

The present invention relates to an instantaneous fuel consumption displaying device for a vehicle. More specifically, to an instantaneous fuel consumption displaying device for a vehicle that displays information on an instantaneous fuel consumption in accordance with instruction information (injection pulse), about fuel injection, which is inputted from control means to a fuel injection device.

2. Description of Background Art

A device which arithmetically operates a remaining amount of fuel within a fuel tank is known in an electronic control fuel injection system which injects fuel into an inlet pipe in accordance with an injection pulse generated from control means (ECU) depending on an operation situation of an engine. Japanese Patent Laid-Open No. Sho 63-25517 proposes a device wherein an injection pulse is transmitted from an ECU to a meter through a communication line. The meter arithmetically operates an amount of fuel consumption based on the number of injection pulses thus received, and subtracts the amount of fuel consumption thus arithmetically operated from an amount of full load of a fuel, thereby arithmetically operating a remaining amount of fuel.

There is a desire that as a measure when a vehicle is economically driven, an amount of fuel consumption is desired to be arithmetically operated within a very short cycle (for example, a cycle of 0.5 sec) based on an amount of injected fuel in order to display information on an instantaneous fuel consumption on a meter separately from an average fuel consumption. In order to attain this desire, there is required an arithmetic operation for which it takes a shorter time than that required for a conventional arithmetic operation for an average fuel consumption. However, with the conventional device that transmits the information on an amount of injected fuel based on the injection pulse to the meter, when the communication line through which a fuel injection controlling unit and the meter are connected to each other is long, an arithmetic operation error is generated because a noise is easily provided in the communication line. In particular, since in a motorcycle, a communication line is distributed in the vicinity of an engine to which an ignition noise is easily provided in many cases, there is required means for arithmetically operating an amount of fuel consumption in which a communication error of an injection amount information due to the ignition noise is taken into consideration.

SUMMARY AND OBJECTS OF THE INVENTION

It is therefore an object of an embodiment of the present invention to provide an instantaneous fuel consumption displaying device for a vehicle which is capable of displaying thereon information on an instantaneous fuel consumption based on an amount of injected fuel arithmetically operated based on proper injection amount information in consideration of a communication error of the injection amount information transmitted through a communication line.

In order to attain the object according to an embodiment of the present invention, in an instantaneous fuel consumption displaying device for a vehicle having: fuel injecting means (42) for injecting a fuel to an engine (3) in response to an injection pulse inputted thereto; injection controlling means (33) for supplying an injection pulse corresponding to an amount of injected fuel calculated based on an operation situation of the engine (3) to the fuel injecting means (42), and forming information (FI) on the amount of injected fuel in accordance with the number of injection pulses supplied to the fuel injecting means (42); display controlling means (45) for calculating an instantaneous fuel consumption based on the information (FI) on the amount of injected fuel, and displaying information on the instantaneous fuel consumption thus calculated on a display portion (66); and a communication line (48) through which the information (FI) on the amount of injected fuel is transmitted from the injection controlling means (33) to the display controlling means (45). A first feature of the present invention is that the information (FI) on the amount of injected fuel is composed of a plurality of fuel consumption signals, the injection controlling means (33) adds time information to the plurality of fuel consumption signals and sends out the resulting information whenever the number of injection pulses becomes a value corresponding to a predetermined reference instantaneous injection amount, and the display controlling means (45), while receiving the plurality of fuel signals in order, determines whether or not the fuel signal thus received is a predetermined signal, and when the plurality of fuel consumption signals are discriminated by the reference number, decides that the fuel for the reference instantaneous injection amount is injected to calculate the instantaneous fuel consumption, thereby displaying information on the instantaneous fuel consumption.

In addition, according to an embodiment of the present invention, the plurality of fuel consumption signals are composed of digital data (ID) containing therein time information which is reset whenever the instantaneous fuel consumption is calculated, and the time information of the pieces of digital data (ID) is added to each piece of digital data (ID) based on a value of a counter (C0) which is incremented.

In addition, according to an embodiment of the present invention, whether or not the plurality of fuel consumption signals are discriminated by the reference number is determined in accordance with whether or not a value of a tentative decision counter (C1) that is updated whenever the fuel consumption signal is properly received reaches a predetermined number, and at a time point when the plurality of fuel consumption signals are properly received by the predetermined number, counting processing is ended by the tentative decision counter (C1).

In addition, according to an embodiment of the present invention, each of the plurality of fuel consumption signals is composed of plurality of sub-signals.

In addition, according to an embodiment of the present invention, with respect to information on a present amount of injected fuel, the instantaneous fuel consumption is calculated in accordance with a correction distance (D'n) obtained by subtracting a free operating distance obtained by multiplying a time it takes from a time point when the first fuel consumption signal of the information on the present amount injected fuel is received to a time point when it is decided that the fuel for the reference instantaneous injection amount is injected by an average vehicle speed for the time concerned from a operating distance (Dn) at a time point when it is decided that the fuel for the reference instantaneous injection amount is injected, and a last correction distance (D'n−1) corresponding to the correction distance.

In addition, according to an embodiment of the present invention, in a front-back direction of a vehicle body of a motorcycle (1) loaded with the engine (3), the injection controlling means (33) is disposed in a rear of the engine (3), a meter (31) provided with the display portion (66) is disposed in front of the engine (3), and the display portion (66) displays thereon the information on the instantaneous fuel consumption in a digital manner and is disposed adjacent to a digital vehicle speed displaying portion (65) on the meter (31).

In addition, according to an embodiment of the present invention, the information on the instantaneous fuel consumption is displayed for a time previously set on the display portion (66).

In addition, according to an embodiment of the present invention, when it is not decided that the fuel for the reference instantaneous injection amount is injected within a period of time for sending the information (FI) on the amount of injected fuel, instantaneous fuel consumption fail display is carried out instead of carrying out the instantaneous fuel consumption display.

In addition, according to an embodiment of the present invention, when it is not decided that the fuel for the reference instantaneous injection amount is injected at a time point of an end of the period of time for sending of the information (FI) on the amount of injected fuel, the instantaneous fuel consumption fail display is carried out for a time corresponding to the period of time for the sending of the information (FI) on the amount of injected fuel, and the period of time for sending of the information (FI) on the amount of injected fuel is set approximately equal to a vehicle speed fail display period of time information on which is displayed on the digital vehicle speed displaying portion (65).

According to an embodiment of the present invention, since the information on the amount of injected fuel is representative of a given amount of injected fuel based on the injection pulses, the instantaneous fuel consumption can be readily calculated by using the information on the amount of injected fuel supplied from the control means. Therefore, the convenience is high in calculating the instantaneous fuel consumption. In addition, the information on the amount of injected fuel is composed of the plurality of fuel consumption signals, a predetermined number of fuel consumption signals of the plurality of fuel consumption signals is properly received, thereby making it possible to decide that a given amount of fuel is injected. Therefore, even when noise is provided to the communication line through which the information on the amount of injected fuel is transmitted, it is avoided that it is impossible to receive all of the plurality of fuel consumption signals composing the information on the amount of injected fuel. Therefore, in the motorcycle in which the communication line is distributed in the vicinity of the engine as a noise generation source, it is possible to construct the system having resistance to the noise.

According to an embodiment of the present invention, since the time information can be added to the digital data as the fuel consumption signal in accordance with the counter value which is incremented, it is possible to readily confirm that the digital data is regularly transmitted and received in order.

According to an embodiment of the present invention, since it is possible to confirm whether or not the digital data is precisely received through the counting processing by the counter and at a time point when the reception of a predetermined number of pieces of digital data is confirmed, the counting processing for the plurality of pieces of digital data is stopped, it is possible to lightened the load burdened on the control means.

According to an embodiment of the present invention, whether or not the proper information on the amount of injected fuel is received is in accordance with the presence or absence of a lack of the plurality of fuel consumption signals which are sent.

According to an embodiment of the present invention, it is possible to reduce an influence for the free operation for a time until it is decided that a predetermined amount of fuel is injected. In particular, since the influence by the free operation distance becomes larger when the vehicle is operated at a high vehicle speed, the effect of the instantaneous fuel consumption display based on the correction distance is large.

According to an embodiment of the present invention, even when the communication line is distributed on the upper portion of the engine mounted to the motorcycle and thus the noise is readily provided to the signal transmitted through the communication line, it is possible to display the information on the precise instantaneous fuel consumption. In addition, the present invention is suitable for displaying the information on the instantaneous fuel consumption with high precision under the situation that since it is difficult to ensure a small space in the meter of the motorcycle and both of the information on the vehicle speed and the information on the instantaneous fuel consumption are digitally displayed with small sizes, respectively, changes in the digital numerical values are conspicuous if the precision is poor.

According to an embodiment of the present invention, since the information on the instantaneous fuel efficiencies having the same contents can be displayed for a given time, a crew can be made to readily grasp the instantaneous fuel consumption.

According to an embodiment of the present invention, the fail display is carried out when the state of the communication between the injection controlling means and the meter is poor, whereby the information on the instantaneous fuel consumption can be prevented from being displayed with the low precision.

According to an embodiment of the present invention, the period of time for the display of the fail state about the vehicle speed, and the period of time for the display of the fail state about the instantaneous fuel consumption are set approximately equal to each other, whereby it is possible to reduce a feeling of strangeness which the fail display provides to the operator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 is a schematic diagram showing digital data composing the information on the amount of injected fuel;

FIG. 6 is a view showing numerical values of time information added to the digital data;

FIG. 7 is a schematic diagram showing the information on the amount of injected fuel containing therein reception errors of the digital data;

DETAILED DESCRIPTION OF THE PREFERRED EMBODIMENTS

Figure 1:
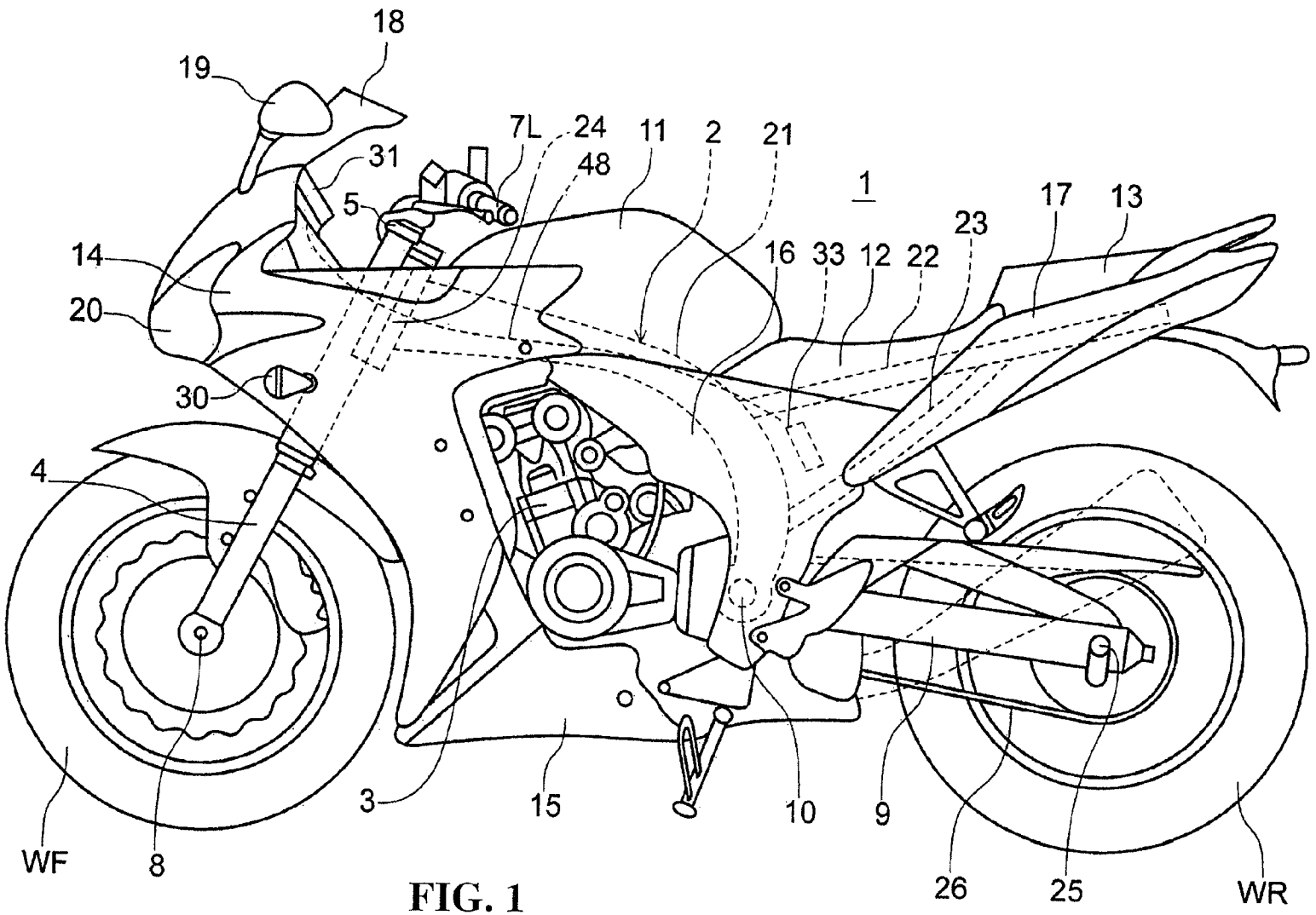
FIG. 1 is a left-side elevational view of a motorcycle having a fuel consumption displaying device according to an embodiment of the present invention.
Figure 2:
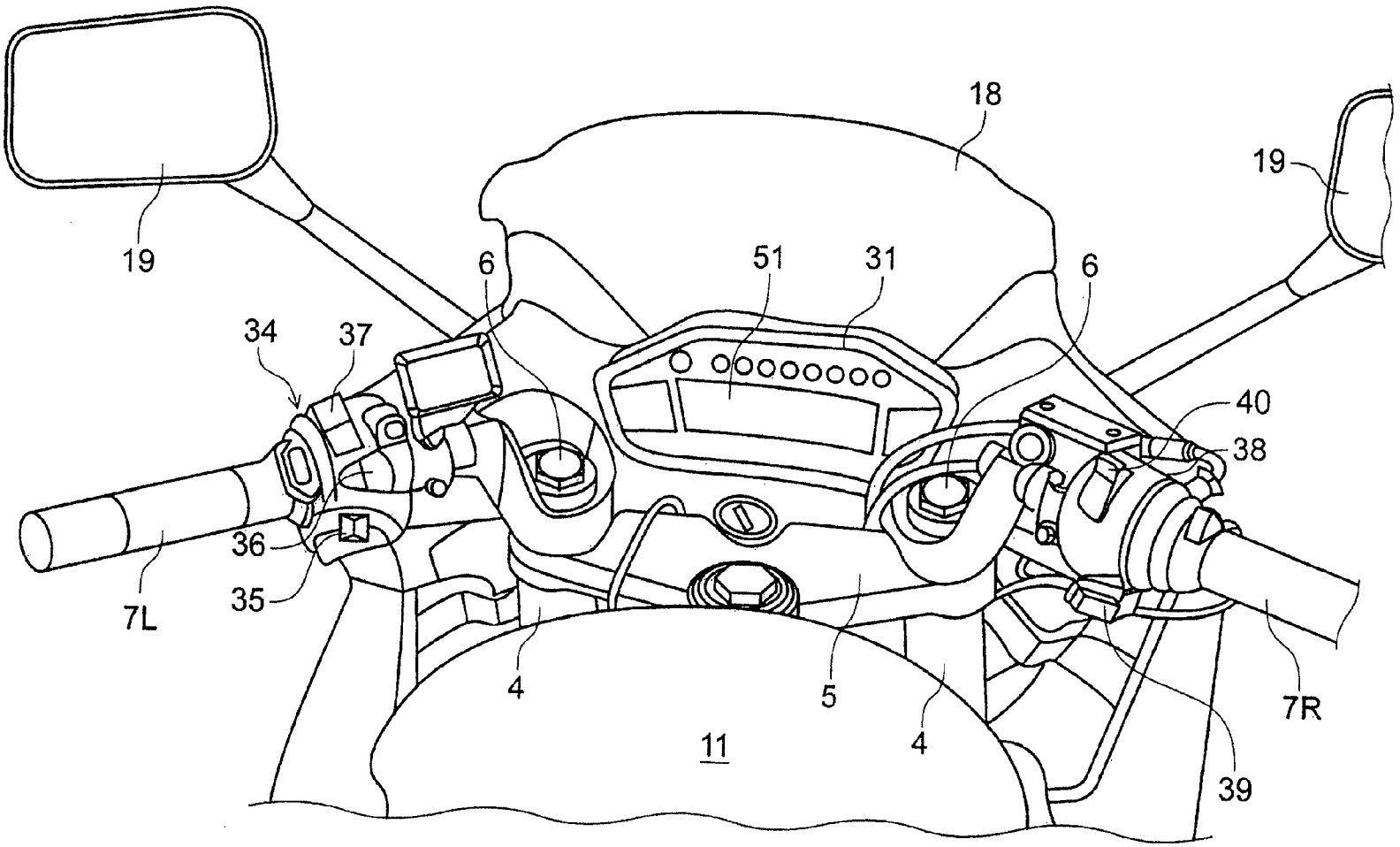
FIG. 2 is a perspective view when a vehicle body front portion of the motorcycle is viewed from the upper rear side of the vehicle body.

Hereinafter, an embodiment of the present invention will be described with reference to the accompanying drawings. FIG. 1 is a side elevational view of a motorcycle to which a fuel consumption displaying device for a vehicle according to an embodiment of the present invention is applied and FIG. 2 is a perspective view when a vehicle body front portion is viewed from a vehicle body upper rear side. The motorcycle 1 has a mono-backbone type vehicle body frame 2 in which a fuel injection system engine 3 is suspended from a main frame 21 having an aluminum die-cast construction which is rectangular in cross section. Heads (front end portions) of a seat frame 22 and a sub-frame 23 that extend posterior to the vehicle body are joined to the main frame 21. A head pipe 24 that extends in a vertical direction is joined to a front end portion of the main frame 21. A front fork 4 is pivotally connected to the head pipe 24 by a steering shaft (not shown). Upper end portions of the front forks 4 that are provided on the right and left sides on one-by-one basis are coupled to each other at a top bridge 5. Right- and left-side handles 7R and 7L are fixed to the top bridge 5 by bolts 6 and 6 extending up to the upper end portions of the front forks 4, respectively. A front wheel WF is rotatably supported in the low end portions of the front forks 4 by a front wheel shaft 8.

A pivotal shaft 10 which swingably supports vertically a swing arm 9 is provided in the lower end portion of the main frame 21. A rear wheel WR is supported in a rear end portion of the swing arm 9 by a rear wheel shaft 25. A driven-side sprocket (not shown) is provided coaxially with the rear wheel WR, and a driving chain 26 is suspended between the driven-side sprocket and a driving-side sprocket (not shown) provided in an output shaft of the engine 3.

A fuel tank 11 is mounted to the upper portion of the main frame 21, and a seat 12 for a crew, and a seat 13 for a fellow passenger are mounted to an upper portion of a seat frame 22. The vehicle body frame 2 is covered with a vehicle body cover, in a word, a cowl. The cowl is divided into a front cowl 14, an under cowl 15, a side cowl 16, a rear cowl 17, and the like. Not only a visor 18 is provided in the front cowl 14; but also a mirror 19, a head light 20, and a blinker lamp 30 are mounted to the front cowl 14.

A meter 31 is disposed between the top bridge 5 and the visor 18. The meter 31 includes a digital display portion 51 that will be described in detail later. The digital display portion 51 is configured so as to display thereon information on a remaining amount of fuel and information on an instantaneous fuel consumption in addition to information on a vehicle speed. Injection controlling means (an ECU including a microcomputer) 33 for carrying out electronic fuel injection control for the engine 3, and supplying information representing an operating state of the motorcycle 1 for display by the meter 31 can be provided between the seat frame 22 and the sub-frame 23 in the rear of the engine 3 suspended by the main frame 21. A communication line 48 that will be described later and through which digital data is transmitted is distributed between the ECU 33 and the meter 31.

A blinker switch 35, a horn switch 36, a dimmer switch 37, and the like are provided in a switch box 34 of the left-side handle 7L. A starter switch 39, a kill switch 40, and the like are provided in a switch box 38 of the right-side handle 7R.

Figure 3:
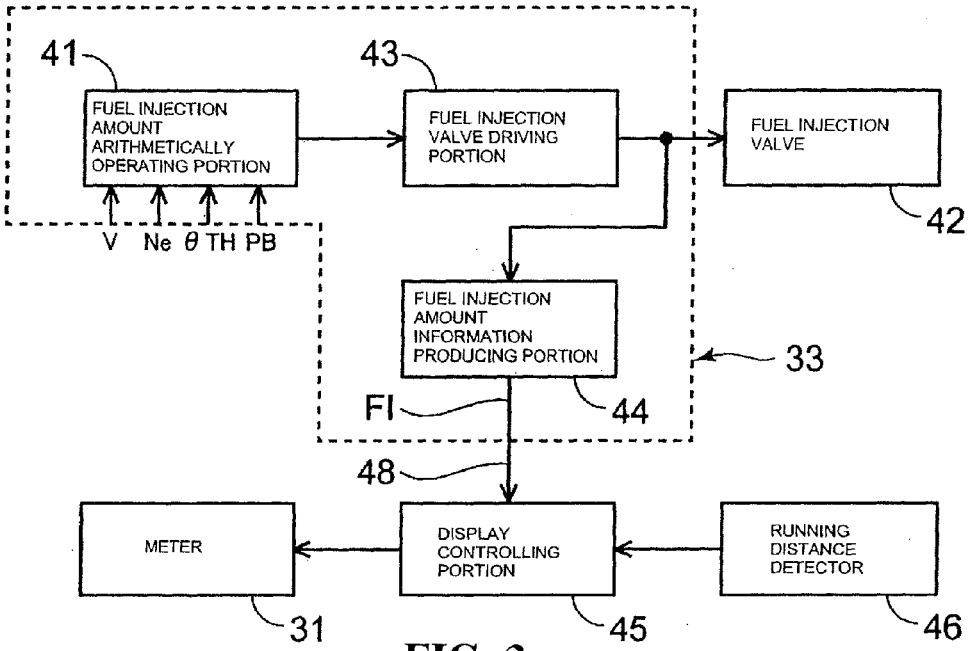
FIG. 3 is a block diagram showing a configuration of an ECU for displaying information on a instantaneous fuel consumption.

FIG. 3 is a block diagram showing a configuration of the ECU 33 for displaying the information on the instantaneous fuel consumption on the meter 31. In FIG. 3, a fuel injection amount arithmetically operating portion 41 calculates an amount of fuel injected by a fuel injection valve 42 by using parameters, representing an operating state of the engine 3, such as a vehicle speed V, an engine-number-of-revolutions Ne, a throttle position θTH, and an inlet pipe negative pressure PB. The amount of injected fuel is calculated as a drive duty (ON time/(ON time+OFF time)) of the fuel injection valve 42 by utilizing the well-known arithmetically operating method. An injection pulse having ON/OFF time corresponding to the drive duty thus calculated is inputted to a fuel injection valve driving portion 43. In response to the injection pulse thus inputted, the fuel injection valve driving portion 43 injects the fuel into the inlet pipe of the engine 3 by driving the fuel injection valve 42.

A fuel injection amount information producing portion 44 produces information FI on an amount of injected fuel used to display the information on the instantaneous fuel consumption on the meter 31 whenever the injection pulses, representing an amount of fuel to be injected, for a predetermined amount of injected fuel are outputted from the fuel injection valve driving portion 43 to the fuel injection valve 42. The information FI on the amount of injected fuel is composed of a fuel consumption signal (digital data) ID composed of a set of digital signals each composed of plurality of sub-signals. The information FI on the amount of injected fuel is composed of a plurality of pieces of digital data ID. Hereinafter, a description will be given on the assumption that the amount of fuel to be injected is 10 cc. In a word, the operating distance per fuel of 10 cc is calculated as the instantaneous fuel consumption. In addition, the plurality of digital signals are described as one pair (two pieces) of digital signals, and the plurality of pieces of digital data ID are described as 13 pieces of digital data ID. In a word, one set of information FI on the amount of injected fuel containing therein 13 pieces of digital data ID each composed of the pair of digital signals is produced whenever the fuel for 10 cc is injected.

The information FI on the amount of injected fuel thus produced is inputted to a display controlling portion 45 disposed away from the ECU 33 through the communication line 48. The display controlling portion 45 is either disposed close to the meter 31 or disposed integrally with a case which the display controlling portion 45 and the meter 31 hold in common in the meter 31. The digital data is outputted every lapse of predetermined time, and each digital data ID has time of the first digital data "ID:0" elapsed from the generation of the first digital signal in the form of information. In a word, 13 pieces of digital data ID:0 to ID:12 are set from the ECU 33 one after another, and each digital data ID has the time information starting on a phase of start of sending of the digital data ID:0 (a phase of end of the calculation of the last instantaneous fuel consumption).

The display controlling portion 45 decides the amount of injected fuel when it is determined that a predetermined number (for example, three) of the digital data ID has been properly received. Also, information on the operating distance from a phase of the last decision of the amount of injected fuel to a phase of the present decision of the amount of injected fuel is acquired from an operating distance detector 46, and the calculation of the fuel consumption is started in accordance with the amount of injected fuel which has been decided this time, and the operating distance thus acquired. The operating distance detector 46, for example, detects the operating distance in accordance with the number of revolutions of the rear wheel WR of the motorcycle 1.

Figure 4:
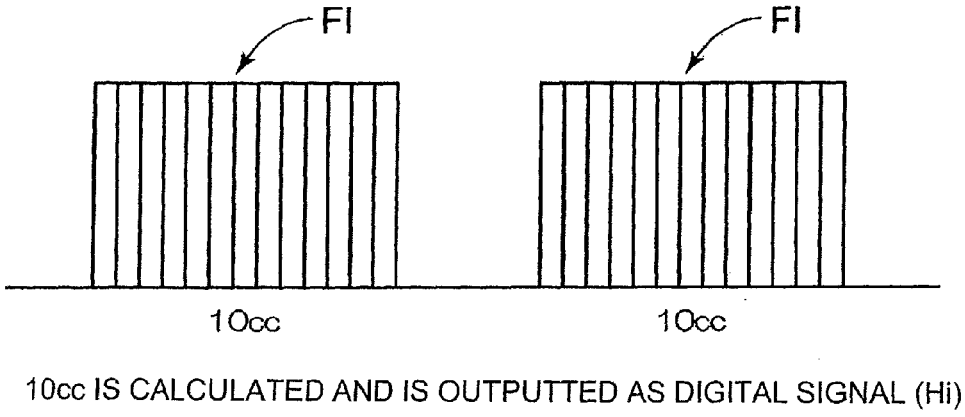
FIG. 4 is a schematic diagram showing information on an amount of injected fuel.

FIG. 4 is a schematic diagram of fuel injection amount display data. As shown in FIG. 4, whenever the fuel of 10 cc is injected from the fuel injection valve 42, 13 pieces of digital data ID each composed of the plurality of digital signals (high signals) are produced as the information FI on the amount of injected fuel in the injection amount information producing portion 44 and are then outputted.

FIG. 5 is an enlarged diagram of the digital data ID shown in FIG. 4. As shown in FIG. 5, whenever the instantaneous fuel consumption is calculated (integration is ended), the digital data ID:0, ID:1, ID:2, . . . , ID:12 is outputted in order. An interval between each adjacent two pieces of digital data ID, for example, is 40 milliseconds. An interval between each adjacent digital signals (sub-signals) in each piece of digital data ID, for example, is 5 milliseconds. It is noted that the digital data ID is by no means limited in composition to a pair of two digital signals, and thus all it takes is that the digital data ID is composed of a plurality of digital signals. For example, a set of three digital signals can compose one piece of digital data ID.

FIG. 6 is a view showing information, on the time from the end of integration, which is added to the digital data ID. The time information is a value that increases from ID:0 to ID:12 from "10000" to "11100" in order, and can be generated by an increment counter C0. Thirteen pieces of time information that are arranged in order in such a way are transmitted, whereby the digital controlling portion 45 can readily confirm that 13 pieces of digital data ID can be received in order.

As shown in FIG. 5, there is no problem as long as the proper digital data ID in which two pulses get together is transmitted to the display controlling portion 45. However, the properly composed digital data cannot be received in some cases. Therefore, at a time point when of 13 pieces of digital data ID, three pieces of digital data ID have been properly received, it is determined that the fuel of 10 cc has been injected and the fuel consumption is then calculated, and the information on the fuel consumption is displayed on the meter 31. Whether or not three pieces of digital data ID have been properly received can be determined based on the fact that a value, of a tentative decision counter C1, which is incremented whenever the proper digital data ID is received has become a predetermined value ("3"). At a time point when the value of the tentative decision counter C1 has become "3," the value of the tentative decision counter C1 is reset, and of the fuel injection amount display data concerned, the remaining digital data is not counted. Processing in the tentative decision counter C1 is made to an early end, whereby it is possible to lighten the load burdened on the fuel injection amount display data producing portion 44.

FIG. 7 is a schematic diagram showing an example of processing when the digital data is received in which the pulses are not properly paired with each other. In FIG. 7, since in the first digital data ID:0, two pulses do not get together, a reception error (NG) is set. Since in the next digital data ID:1, levels of two digital signals are equal to each other, it is determined that the reception is successful, and the value of the tentative decision counter C1 is incremented. Since in the next digital data ID:2, two digital signals are not properly received and one of them lacks, the reception error (NG) is set. In addition, since in the next digital data ID:3, two digital signals are properly received, it is determined that the reception is successful, and the value of the tentative decision counter C1 is incremented. Whenever the digital data ID in which the two digital signals properly get together has been received, the value of the tentative decision counter C1 is incremented. Also, at a time point when the value of the tentative decision counter C1 becomes "3," the digital data ID representing the amount of injected fuel of 10 cc is decided, and from then on, the processing for updating the value of the tentative decision counter C1 is not executed.

Figure 8:
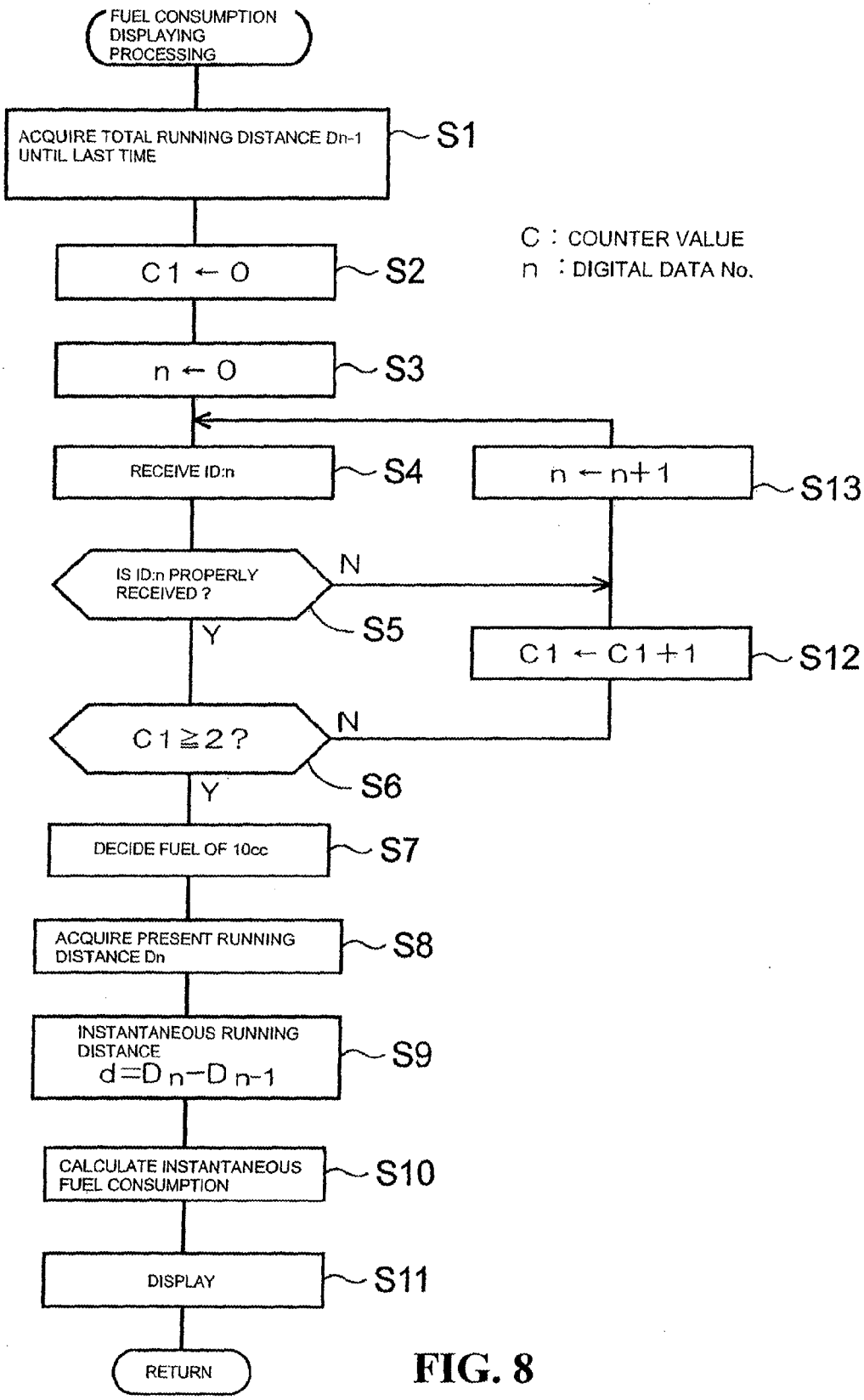
FIG. 8 is a flow chart explaining fuel consumption displaying processing including processing for receiving the digital data.

FIG. 8 is a flow chart of fuel consumption displaying processing including the processing for receiving the digital data ID in the display controlling portion 45. In FIG. 8, in Step S1, information on a total operating distance Dn−1 until a phase of the last decision of the amount of injected fuel is acquired from the operating distance detector 46. In Step S2, the value of the tentative decision counter C1 for counting the number of times of the reception of the proper digital data ID is reset to zero. In Step S3, zero is set to a number, n, of the digital data ID. In Step S4, the n-th digital data is received. Since at first, in Step S3, n=zero is set, the digital data ID:0 is received.

In Step S5, it is determined whether or not the digital data ID:n can be properly received. When it is determined in Step S5 that the digital data ID:n is properly received, the operation proceeds to processing in Step S6, and it is determined whether or not the value of the tentative decision counter C1 is equal to or larger than "2." Since in the phase of the first determination in Step S6, the value of the tentative decision counter C1 is reset to zero in Step S2, the determination in Step S6 proves to be negation and the operation proceeds to processing in Step S12 in order to increment the value of the tentative decision counter C1. In addition, in Step S13, the number, n, of the digital data ID is incremented and the operation then proceeds to processing in Step S4.

When the value of the tentative decision counter C1 is incremented to become equal to or larger than "2," the determination in Step S6 proves to be affirmation. Thus, the operation proceeds to processing in Step S7, and the amount of injected fuel of 10 cc is decided. In Step S8, information on the present operating distance Dn is acquired from the operating distance detector 46. In Step S9, an instantaneous operating distance, d, is calculated. The instantaneous operating distance, d, is calculated by using an expression d=(Dn−Dn−1).

In Step S10, an instantaneous fuel consumption is calculated from the operating distance, d, for an amount Fe of fuel consumption (that is, 10 cc). In Step S11, information on the instantaneous fuel consumption thus calculated is displayed on the meter 31.

Figure 9:
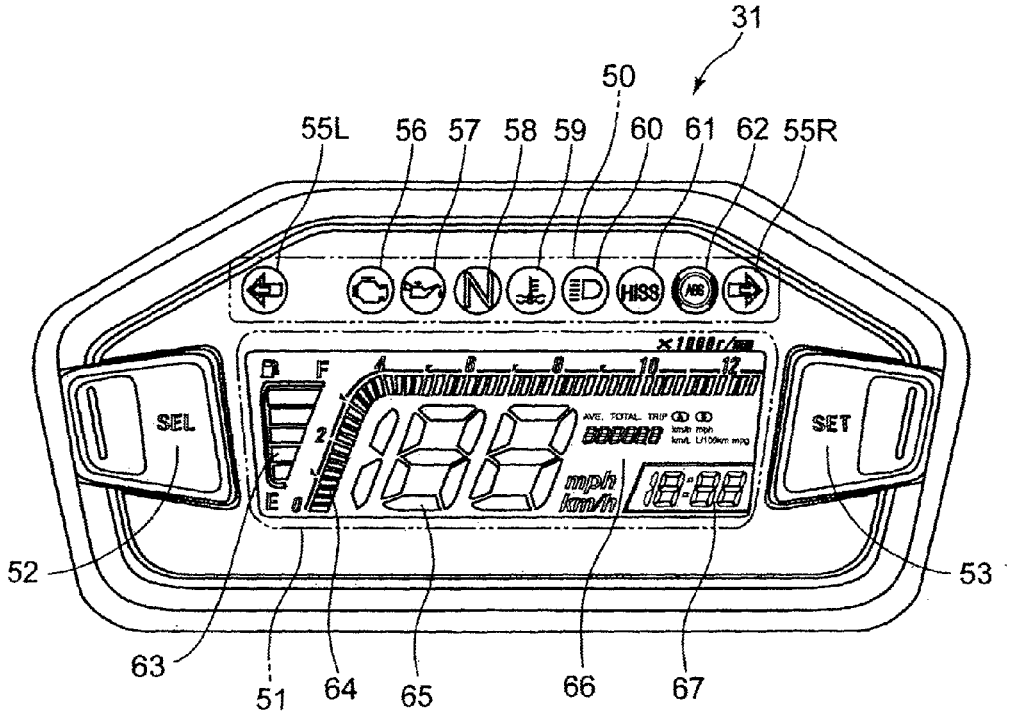
FIG. 9 is a front view of a meter provided in a motorcycle.

FIG. 9 is a front view of a concrete example of the meter 31. In FIG. 9, the meter 31 has a first display portion 50, a second display portion 51, a select switch (SEL) 52 and a set switch (SET) 53 each serving as a manipulation switch. The first display portion 50 is composed of directional signal indications 55L and 55R which are lightened so as to correspond to an operation of a direction indicator, a PGM-EFI warning light 56 that represents a state of a fuel injection controller, an oil warning light 57, a variable speed indicator 58 that represents a variable speed stage selected at present, a cooling water temperature meter 59, an indicator 60 that represents a lighting state of a headlight, an immobilizer indicator 61 that represents a state of a smart card key system, and an ABS indicator 62 that represents an operation state of an ABS.

The second display portion 51 is a digital display portion composed of plurality of segments, and includes a fuel remaining amount display 63, an engine-number-revolutions display portion 64, a vehicle speed display portion 65, an odo/trip meter 66, and a clock 67. Information on fuel efficiencies (an instantaneous fuel consumption and an average fuel consumption) can be displayed on the odo/trip meter 66 through the automatic switching.

Figure 10:
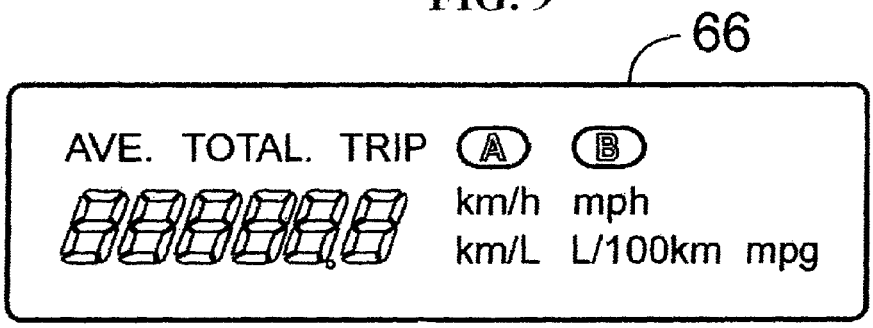
FIG. 10 is an enlarged view of an odo/trip meter.

FIG. 10 is an enlarged view of the odo/trip meter 66. Six segments for digitally displaying a six-digit numerical value, and characters representing an average fuel consumption (AVE.), a total operating distance (TOTAL), a section operating distance (TRIP), and "A" and "B" representing two section operating distances (a trip A and a trip B), respectively, are provided in the odo/trip meter 66 so as to be capable of being displayed depending on a display mode. Units of the numerical values which are to be displayed are provided on a right side of the six segments.

Figure 11:
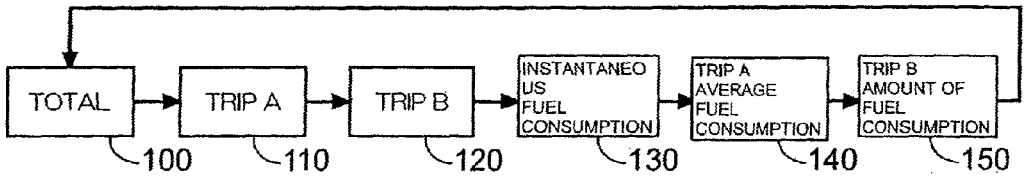
FIG. 11 is a flow chart showing a normal operational mode for displaying switching for a meter.

FIG. 11 is a flow chart showing a normal operation mode for display switching in the odo/trip meter 66. The displays in Steps are switched in order by carrying out a push operation for the select switch 52. In a total display mode in Step 100, the information on the total operating distance (TOTAL) is displayed. When the select switch 52 is push-manipulated, the operation proceeds from Step 100 to Step 110 to switch the total display mode over to a display mode of the trip A (TRIP A), in a word, the section operating distance A. When the select switch 52 is further push-manipulated, the operation proceeds to processing in Step 120 to switch the display mode of the section operating distance A over to a display mode of a trip B (TRIP B), in a word, the section operating distance B. The trip A and the trip B are respectively the operating distances after resetting have been made at different timings. When in the display mode of the trip B, the select switch 52 is push-manipulated, the operation proceeds to processing in Step 130 to switch the display mode of the trip B over to the display mode of the instantaneous fuel consumption. The information on the fuel consumption which has been calculated based on the operating distance while the predetermined amount of fuel (of 10 cc) has being injected as described above is displayed in the instantaneous fuel consumption display mode. When the select switch 52 is push-manipulated, the operation proceeds to processing in Step 140 to switch the instantaneous fuel consumption display mode over to the average fuel consumption display mode of the trip A. When in the average fuel consumption display mode of the trip A, the select switch 52 is push-manipulated, the operation proceeds to processing in Step 150 to switch the average fuel consumption display mode of the trip A over to the fuel consumption amount display mode of the trip B. When the select switch 52 is further push-manipulated, the operation proceeds to the total display mode (Step S100).

In the normal operation mode, both of the select switch 52 and the set switch 53 are long pushed or pushed for a long time, whereby the operation can proceed to the setting mode for the display contents. The wording "long push" means a manipulation for second time longer than that in the push manipulation.

Figure 12:
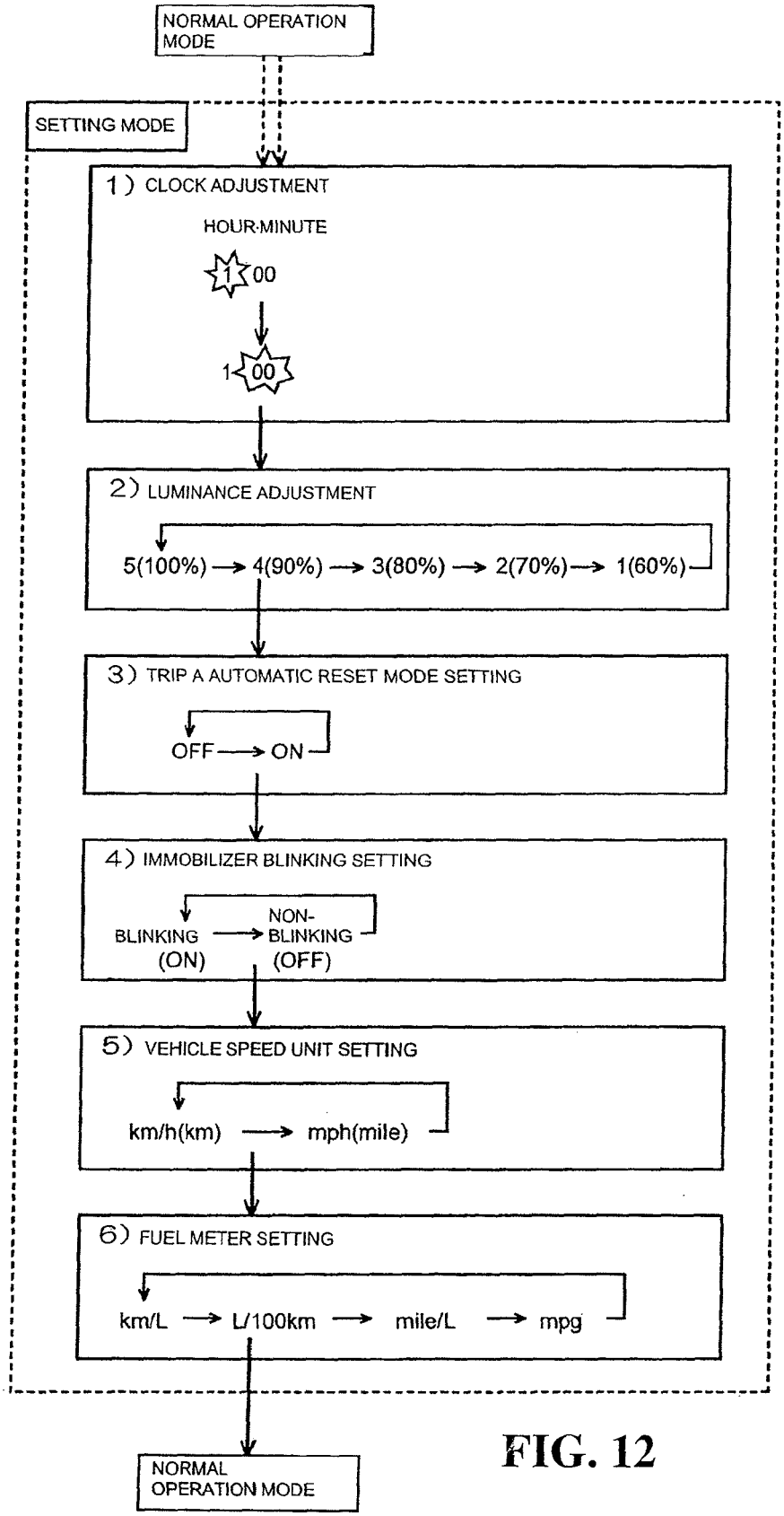
FIG. 12 is an explanatory diagram of a setting mode for a meter.

FIG. 12 is an explanatory diagram of the setting modes. When the operation proceeds from the normal operation mode to the setting mode, firstly, the operation enters a clock adjusting mode. In the clock adjusting mode, adjustment of time of the clock 67 (adjustment of hour and minute) can be carried out. Since in the clock adjusting mode, the display of "hour" is switched with rapidity whenever the select switch 52 is push-manipulated, if the set switch 53 is push-manipulated when "hour" is switched over to a desired "hour," the setting of "hour" is completed. When the select switch 52 is long pushed instead of being push-manipulated, a "first increment" operation is carried out in which while the select switch 52 is long pushed, the display of "hour" is automatically switched in sequence.

When the desired "hour" has been set, next, the adjustment of "minute" becomes possible. For example, a display portion of "minute" in the clock 67 is displayed in a blinking manner, which can cause a user to recognize that the adjustment of "minute" is possible. When in this state, the select switch 52 is push-manipulated, the display of "minute" is switched whenever the select switch 52 is push-manipulated. Thus, if the select switch 53 is push-manipulated when "minute" is switched over to a desired "minute," the setting of "minute" is completed. The fast increment operation is possible even in the setting of "minute."

When the adjustment of "minute" has been completed, the operation proceeds to a luminance adjusting mode. In the luminance adjusting mode, a display luminance of the odo/trip meter 66 can be adjusted in five stages. A default value is "5" in the five stages and thus is set to the highest luminance (100%). In the odo/trip meter 66, the segments are lighted by only the number of digits corresponding to the stage of the luminance. For example, in the case of the stage 5, zeros are displayed in the segments for the five digits, and in the case of the stage 4, zeros are displayed in the segments for the four digits.

In the luminance adjusting mode, whenever the select switch 52 is push-manipulated, the stage of the luminance is switched over to another one in order. If the set switch 53 is push-manipulated, when the stage of the luminance is switched over to the desired stage of the luminance, at this time point, the luminance is decided. During the luminance adjustment, the information on the stage of the luminance being selected at present is displayed on the odo/trip meter 66.

After the luminance has been decided, when the select switch 52 is push-manipulated, the operation proceeds to trip A automatic reset mode setting. In this mode setting, whenever the select switch 52 is push-manipulated, ON and OFF of the trip A automatic reset mode are alternately switched over to each other. Also, when the select switch 52 is push-manipulated, ON or OFF of the trip A automatic reset mode is decided. During the adjustment of the trip A automatic reset mode, the display portion of "A" on the odo/trip meter 66 is illuminated, and the digital character of "ON" or "OFF" is displayed in the blinking manner.

When the adjustment of the trip A automatic reset mode has been completed, the operation can proceed to the setting about whether or not the blinking operation of the immobilizer indicator 60 is carried out by the push operation for the select switch 52. During this adjustment, the immobilizer indicator 60 is illuminated, and "ON" or "OFF" corresponding to ON/OFF of the blinking operation of the immobilizer indicator 60 is displayed on the odo/trip meter 66 in the blinking manner. Whenever the select switch 52 is push-manipulated, ON and OFF of the immobilizer indicator 60 are alternately switched over to each other. When the select switch 52 is push-manipulated, ON or OFF of the blinking operation of the immobilizer indicator 60 is decided.

When the setting about whether or not the blinking operation of the immobilizer indicator 60 is carried out has been completed, and the select switch is then push-manipulated, the operation proceeds to a vehicle speed unit setting mode. The vehicle speed display can be carried out in the form of either km/h (kilometer/hour) display or mph (mile/hour) display. Thus, whenever the select switch 52 is push-manipulated, the vehicle speed units are alternately switched over to each other. During the setting of the vehicle speed unit, the information on the vehicle speed unit being selected is displayed on the vehicle speed displaying portion 65. If the set switch 53 is push-manipulated when the information on the desired vehicle speed unit is displayed, the vehicle speed unit is decided. During the adjustment of the trip A automatic reset mode, the digital character representing the vehicle speed unit is displayed on the odo/trip meter 66 in the blinking manner.

When the setting of the vehicle speed unit has been completed, the operation proceeds to a fuel consumption meter setting mode by push-manipulating the select switch 52. In the fuel consumption setting mode, whenever the select switch 52 is push-manipulated, the fuel consumption display units of km/L (an operating kilometer number per one liter), L/100 km (an amount of fuel consumption per 100 km of operation), mile/L (an operating mile number per one liter), and mpg (an operating mile number per one gallon) are switched to one another in order, and the information on the resulting fuel consumption display unit is displayed on the odo/trip meter 66. When the set switch 53 is push-manipulated in a state in which the fuel consumption display unit is switched over to the desired fuel consumption display unit, the fuel consumption display unit is decided.

If the select switch 52 is push-manipulated when the unit setting of the fuel consumption meter has been completed, the operation returns back to the normal operation mode for the display switching for the odo/trip meter 66.

Figure 13:
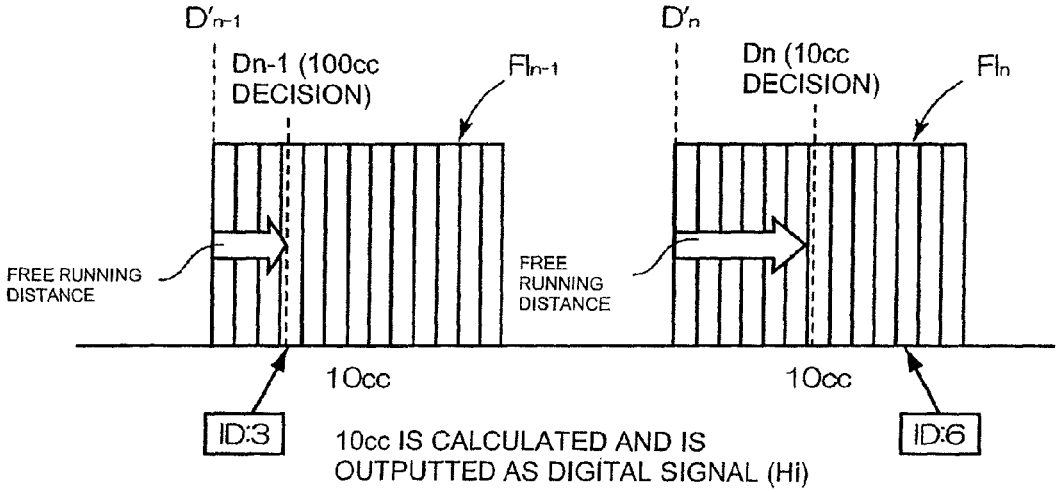
FIG. 13 is a schematic diagram of information on an amount of injected fuel explaining a method of correcting an instantaneous fuel consumption.

Next, a description will be given with respect to a method of correcting the instantaneous fuel consumption which can further enhance the display precision of the instantaneous fuel consumption. FIG. 13 is an explanatory diagram of a method of correcting the instantaneous fuel consumption and is also a schematic diagram showing the information FI on the amount of injected fuel. In FIG. 13, it is supposed in the last calculation cycle in the display controlling portion 45 that at a time point when of 13 pieces of digital data ID, the fourth digital data ID:3 of information FI−1 on the amount of injected fuel has been received, the fuel injection for a reference instantaneous injection amount (10 cc) is carried out. Also, it is supposed in the present calculation cycle that at a time point when of 13 pieces of digital data ID of the information FI on the amount of injected fuel, the seventh digital data ID:6 has been received, the fuel injection for 10 cc is carried out.

When the timing at which it is decided that the fuel injection for 10 cc is carried out (hereinafter referred to as "an injection amount decision phase") differs every calculation processing cycle, an error is generated in the operating distance for the instantaneous fuel consumption calculation. The reason for this is because the operating distance is a difference between the total operating distance in the last injection amount decision phase, and the total operating distance in the present injection amount decision phase, and thus even in the case of the same operating speed, if the preceding injection amount decision phase and the subsequent injection amount decision phase are different from each other, the difference is caused in the operating distance for the calculation due to the difference in the free operating distance as shown in FIG. 13. Then, in this case, the correction is carried out so as to calculate the operating distance on the basis of time points at which the two pieces of first digital data ID:0 of preceding information (FIn−1) on an amount of injected fuel and subsequent information (FIn) on an amount of injected fuel are received.

In the example shown in FIG. 13, the last injection amount decision phase is a phase of reception of the digital data ID:3. Therefore, for obtaining an operating distance D'n−1 at the timing at which the digital data ID:0 is received based on the operating distance Dn−1 in the last injection amount decision phase, the following expression can be used. D'n−1=Dn−1−(Vn (vehicle speed)×160 milliseconds) . . . (Expression 1).

Likewise, since the present injection amount decision phase is a phase of reception of the digital data ID:6, for obtaining an operating distance D'n at the timing at which the digital data ID:0 is received based on the operating distance Dn in the present injection amount decision phase, the following expression can be used. D'n=Dn−(Vn (vehicle speed)×280 milliseconds) . . . (Expression 2). It is noted that reference symbol Vn in Expression 1 and Expression 2 is an average vehicle speed, and is also an average vehicle speed for a period of time from reception of the digital data ID:0 to the injection amount decision phase. It is noted that a value of integration of an acceleration for a period of time from reception of the digital data ID:0 to the injection amount decision phase may be used instead of using the average vehicle speed. In addition, each of the time of "160 milliseconds" and the time of "280 milliseconds" is time elapsed from reception of the digital data ID:0 to the injection amount decision phase. Since an output interval of 13 pieces of digital data ID is 40 milliseconds, and the digital data ID:3 in the last injection amount decision phase is fourth one, the elapsed time is 4×40 milliseconds=160 milliseconds. Also, since the digital data ID:6 in the present injection amount decision phase is seventh one, the elapsed time is 7×40 milliseconds=280 milliseconds.

The instantaneous fuel consumption is calculated based on the operating distance thus calculated by using the following expression 3. The instantaneous fuel consumption=(D'n−D'n−1)/10 cc . . . (Expression 3).

Figure 14:
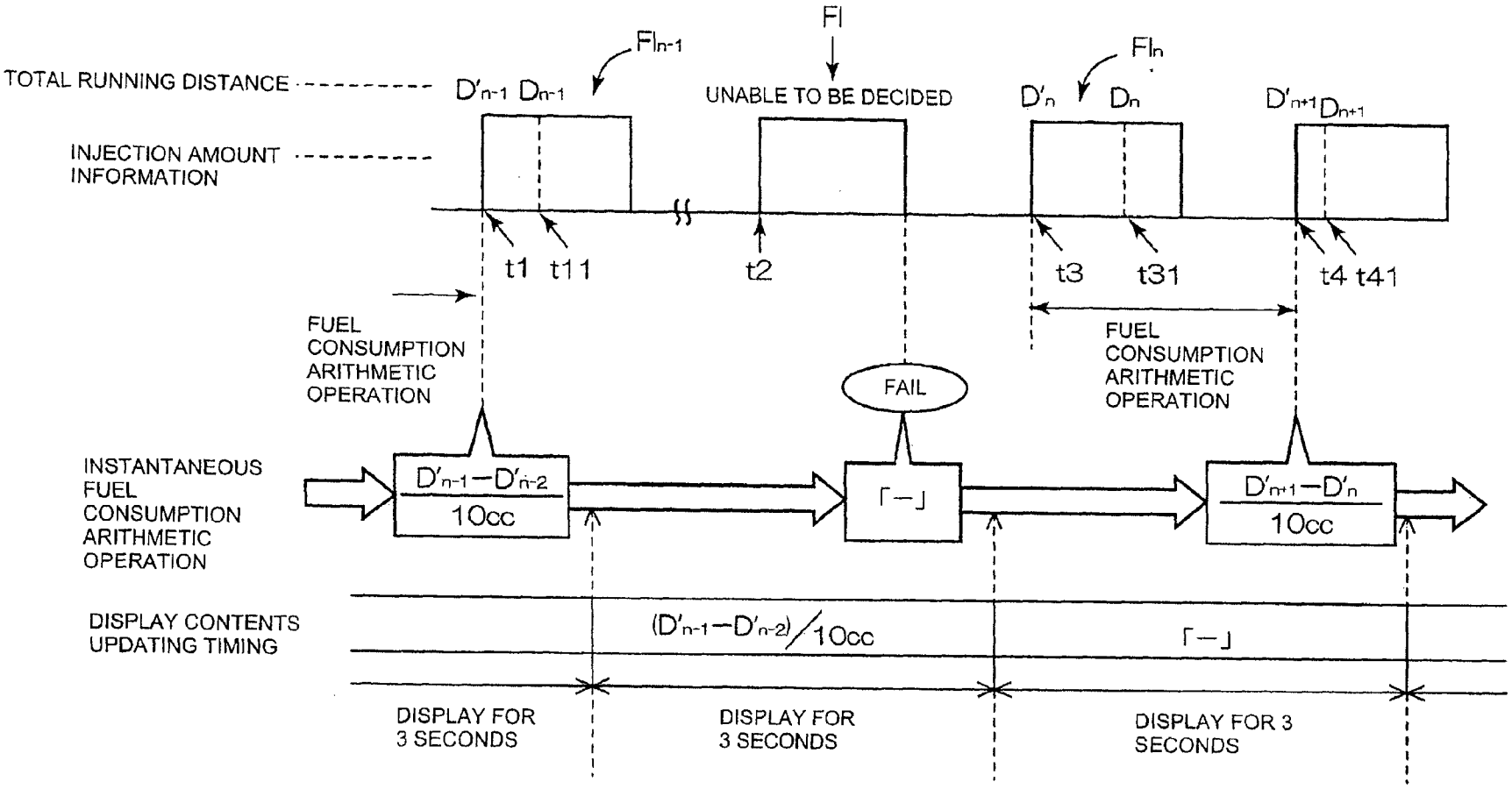
FIG. 14 is a timing chart of instantaneous fuel consumption display including fail processing.

Next, a description will be given with respect to the fail processing in the case where the fuel injection for 10 cc cannot be decided while the information FI on the amount of injected fuel composed of 13 pieces of digital data ID. FIG. 14 is a timing chart of the instantaneous fuel consumption display including the fail processing. In FIG. 14, at a timing t1, the instantaneous fuel consumption is calculated and information on the instantaneous fuel consumption thus calculated is displayed on the meter 31. The calculation of the instantaneous fuel consumption obtained herein is based on the following expression. The instantaneous fuel consumption=(D'n−1−D'n−2)/10 cc . . . (Expression 4). Here, reference symbol D'n−2 is a total operating distance at a time point when the head digital data ID:0 of the information FIn−2 (not shown) on an amount of injected fuel one piece before the information FIn−1 (not shown) on an amount of injected fuel has been received. In this example, an amount of injected fuel of 10 cc is decided at a timing t11 in the middle until the reception of all of 13 pieces of digital data ID:0 to ID:12 of the information FIn−1 on an amount of injected fuel is completed.

When although the information FI on the amount of injected fuel starting on a timing t2 has been received, the amount of injected fuel is not decided based on 13 pieces of digital data ID:0 to ID:12, it is determined that the calculation of the instantaneous fuel consumption fails, in a word, the calculation of the instantaneous fuel consumption is "fail." As far as the display of the information on the instantaneous fuel consumption by the meter 31 is concerned, the instantaneous fuel consumption thus calculated is updated by the newest one with a cycle previously set (for example, three seconds). In a word, the displayed value is switched over to another one every lapse of three seconds. Therefore, when the calculation of the instantaneous fuel consumption is determined as a fail, if the switching timing for the display comes until the arithmetic operation for the instantaneous fuel consumption is completed in the next calculation cycle, then, the display representing that the calculation of the instantaneous fuel consumption is determined as fail is carried out for three seconds. The fact of fail, for example, is represented by the display of a bar ("−").

After the calculation of the instantaneous fuel consumption has been determined as a fail, when the information FIn on an amount of injected fuel is received at a timing t3 and an amount of injected fuel of 10 cc is decided at a timing t31, and further when the information Fin+1 on an amount of injected fuel is received at a next timing t4, the calculation of the instantaneous fuel consumption is carried out. The instantaneous fuel consumption obtained herein is calculated as a value obtained by dividing a difference between the total operating distance (D'n+1) at the timing t3 and the total operating distance (D'n+1) at the timing t4 by 10 cc.

It is noted that in the embodiment, as far as transmission time of the information FI on the amount of injected fuel composed of 13 pieces of digital data, 13 pieces of digital data are sent at an interval of 40 milliseconds, and total transmission time is set to 480 milliseconds. The total transmission time (480 milliseconds) is approximately equal to a period of time (500 milliseconds) for the fail display when the vehicle speed display on the meter 31 was determined as failed. The vehicle speed information and the like are transmitted from the ECU 33 to the meter 31 for 500 milliseconds per one packet. Thus, when a proper value is not transmitted during the transmission of one packet, after a lapse of 500 milliseconds as an interval of transmission of one packet, "−" is displayed on the vehicle speed displaying portion 65 for 500 milliseconds as time for transmission of one packet. Then, similarly to the case of the fail display time for the vehicle speed, the fail display of the instantaneous fuel consumption may be displayed for the total transmission time of 480 milliseconds for 13 pieces of digital data ID instead of carrying out the fail display for 3 seconds as described above. The vehicle speed display fail and the fail display of the instantaneous fuel consumption are set to approximately the same time, whereby it is possible to carry out the fail display not providing a feeling of strangeness to a driver.

Figure 15:
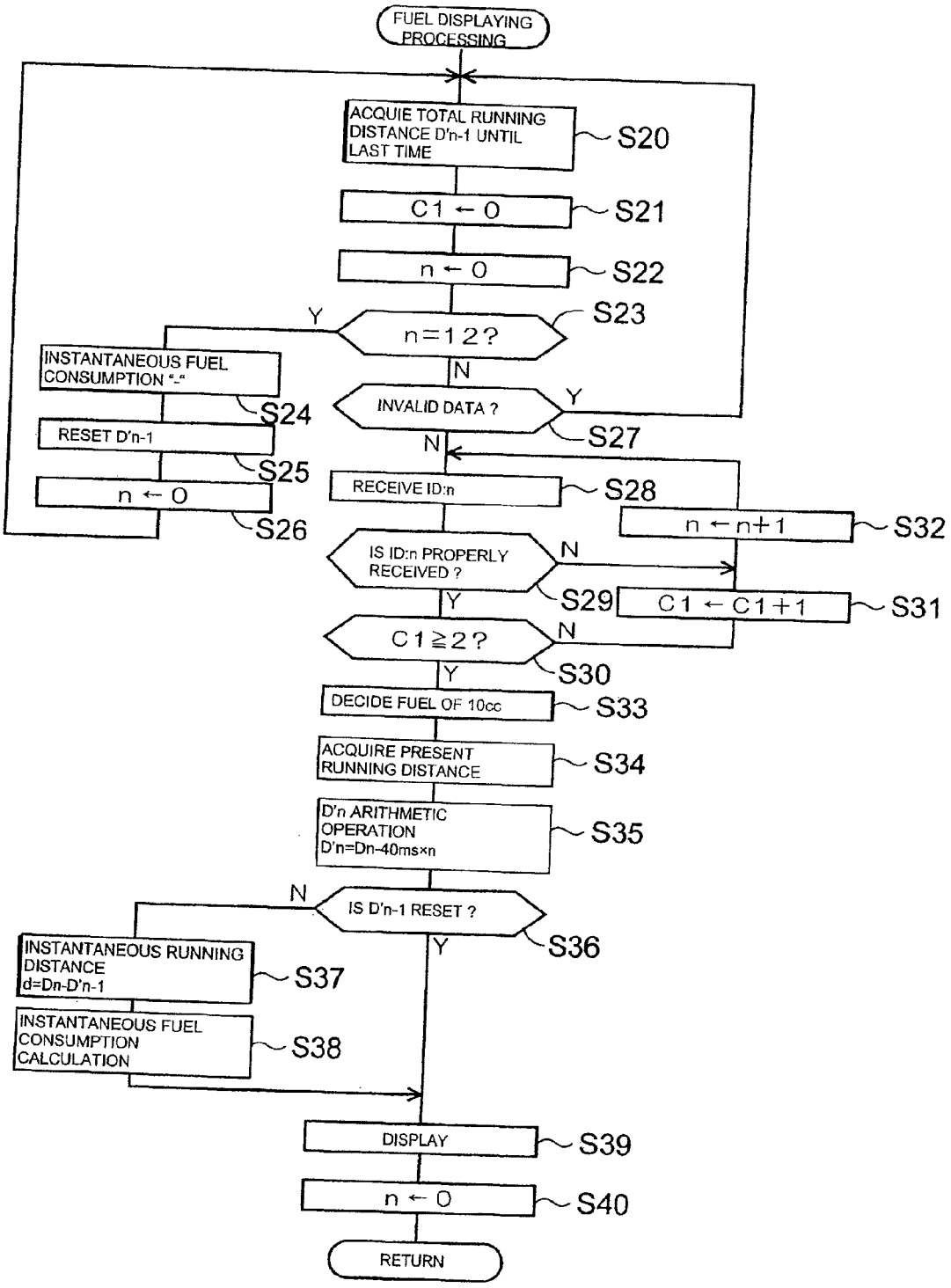
FIG. 15 is a flow chart of fuel consumption displaying processing including the fail display.

FIG. 15 is a flow chart of fuel consumption displaying processing including the fuel display. In FIG. 15, in Step S20, the total operating distance D'n−1 until the last time is acquired. In Step S21, the value of the tentative decision counter C1 for counting the number of times of the reception of the proper digital data ID is reset to zero. In Step S22, the number, n, of the digital data ID is set to zero. After in Step S22, the number, n, of the digital data ID has been set to zero, in Step S23, it is determined whether or not the number, n, of the digital data ID is "12." When in Step S23, the determination proves to be affirmation, it is determined that the amount of injected fuel is not decided until reception of the digital data ID:12, and the operation proceeds to processing in Step S24. Then, the bar display, in a word, the display of the bar "−" representing the fail state of the instantaneous fuel consumption is carried out by the meter 31. In Step S25, the total operating distance D'n−1 thus required is reset, and in Step S26, zero is set to the number n.

When in Step S23, the determination proves to be negation, the operation proceeds to processing in Step S27, and it is determined whether or not invalid data has been received. When it is determined in Step S27 that the invalid data has been received, the operation returns back to the processing in Step S20. On the other hand, when the invalid data has not been received, the operation proceeds to processing in Step S28. In Step S28, the n-th digital data is received. Since at first, in Step S22, the number, n, of the digital data ID is set to zero (n=zero), the digital data ID:0 is received. The invalid noise, for example, is one-shot noise.

In Step S29, it is determined whether or not the digital data ID:n has been properly received. When it is determined in Step S29 that the digital data ID:n has been properly received, the operation proceeds to processing in Step S30, and it is determined whether or not the value of the tentative decision counter C1 is equal to or larger than "2." Since the value of the tentative decision counter C1 is reset to zero in the phase of the first determination in Step S30, the determination in Step S30 proves to be a negation, the operation proceeds to processing in Step S31, and the value of the tentative decision counter C1 is incremented. In addition, in Step S32, the number, n, of the digital data ID is incremented and the operation proceeds to the processing in Step S28.

Since the determination in Step S30 proves to be affirmation when the value of the tentative decision counter C1 is incremented to become equal to or larger than "2," the operation proceeds to processing in Step S33, and the amount of injected fuel of 10 cc is decided. In Step S34, information on the present operating distance Dn is acquired from the operating distance detector 46. In Step S35, the operating distance D'n in the phase of the decision of the amount of injected fuel is arithmetically operated. The operating distance D'n is obtained from D'n=Dn−(40 milliseconds×n). In Step S36, it is determined whether or not the total operating distance D'n−1 until the last time has been reset. When it is determined in Step S36 that the total operating distance D'n−1 until the last time has not been reset, the operation proceeds to processing in Step S37, and the instantaneous operating distance, d, is calculated. The instantaneous operating distance, d, is calculated by using an expression d=(Dn−D'n−1).

In Step S38, the instantaneous fuel consumption is calculated from the operating distance, d, for the amount Fc of fuel consumption (that is, 10 cc). In Step S39, the information on the instantaneous fuel consumption thus calculated is displayed on the meter 31. When the determination in Step S36 proves to be affirmation, the display contents of the instantaneous fuel consumption are switched over to the bar display ("−") as the fail display, and the operation proceeds to processing in Step S39. In Step S40 following Step S39, zero is set as the number, n, of the digital data ID.

The embodiment is one mode for carrying out the present invention, and thus the person skilled in the art can change the embodiment without departing from the scope of the appended claims. For example, the fuel consumption signals composing the information FI on the amount of injected fuel are by no means limited to the digital data and thus may also be analog signals. In addition, the number and intervals of the digital signals composing the digital data ID, and the number and the generation intervals of the digital data can be arbitrarily set. In addition, the decision of the amount of injected fuel is not carried out when three pieces of digital data ID are received, but may be carried out when three or more pieces of digital data ID are received. In addition, although the example in which whenever the fuel of 10 cc is injected, the information FI on the amount of injected fuel is produced to be outputted is given, an amount of fuel corresponding to the information FI on the amount of injected fuel can be arbitrarily set.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of using An instantaneous fuel consumption displaying device for a vehicle comprising:

a fuel injector for injecting fuel into an engine in response to an injection pulse inputted thereto;

an injection controller for supplying an injection pulse corresponding to an amount of injected fuel calculated based on an operational situation of said engine to said fuel injector, and forming information on the amount of injected fuel in accordance with the number of injection pulses supplied to said fuel injector;

a display portion including at least a vehicle speed display portion and an instantaneous fuel consumption display portion, said display portion being positioned in a forward portion of the vehicle;

a display controller for calculating the instantaneous fuel consumption based on the information on the amount of injected fuel, and displaying information on the instantaneous fuel consumption thus calculated on the instantaneous fuel consumption display portion of the display portion, said display portion displays thereon the information on the vehicle speed and the instantaneous fuel consumption in a digital manner;

a communication line through which the information on the amount of injected fuel is transmitted from said injection controller to said display controller;

wherein said instantaneous fuel consumption displaying device for a vehicle includes the information on the amount of injected fuel without interference from engine noise that creates a communication error in the communication line by providing a plurality of fuel consumption signals, the injection controller adds time information to the plurality of fuel consumption signals and sends out the resulting information regarding pulse width duration whenever the number of injection pulses becomes a value corresponding to a predetermined reference instantaneous fuel injection amount, and said display controller, while receiving the plurality of fuel consumption signals in order, determines whether or not the fuel signal thus received is a predetermined signal, and when the plurality of fuel consumption signals are discriminated by a reference number, decides that the fuel for the reference instantaneous injection amount is injected, to calculate the instantaneous fuel consumption, thereby displaying information on the instantaneous fuel consumption without interference from engine noise that would create a communication error, wherein the information on the instantaneous fuel consumption is displayed for a time previously set on said display portion, wherein when it is not decided that the fuel for the reference instantaneous injection amount is injected within a period of time for sending of the information on the amount of injected fuel, instantaneous fuel consumption fail display is carried out instead of carrying out the instantaneous fuel consumption display, and wherein when it is not decided that the fuel for the reference instantaneous injection amount is injected at a time point of end of the period of time for sending of the information on the amount of injected fuel, the instantaneous fuel consumption fail display is carried out for a time corresponding to the period of time for sending of the information on the amount of injected fuel, and the period of time for sending of the information on the amount of injected fuel is set approximately equal to a vehicle speed fail display period of time information on which is displayed on said digital vehicle speed displaying portion.

2. A method of using The instantaneous fuel consumption displaying device for a vehicle according to claim 1, wherein the plurality of fuel consumption signals are composed of digital data containing therein time information that is reset whenever the instantaneous fuel consumption is calculated, and the time information of the pieces of digital data is added to each piece of digital data based on a value of a counter which is incremented.

3. A method of using The instantaneous fuel consumption displaying device for a vehicle according to claim 1, wherein whether or not the plurality of fuel consumption signals are discriminated by the reference number is determined in accordance with whether or not a value of a tentative decision counter which is updated whenever the fuel consumption signal is properly received reaches a predetermined number, and at a time point when the plurality of fuel consumption signals are properly received by the predetermined number, counting processing is ended by said tentative decision counter.

4. A method of using The instantaneous fuel consumption displaying device for a vehicle according to claim 2, wherein whether or not the plurality of fuel consumption signals are discriminated by the reference number is determined in accordance with whether or not a value of a tentative decision counter which is updated whenever the fuel consumption signal is properly received reaches a predetermined number, and at a time point when the plurality of fuel consumption signals are properly received by the predetermined number, counting processing is ended by said tentative decision counter.

5. A method of using The instantaneous fuel consumption displaying device for a vehicle according to claim 1, wherein each of the plurality of fuel consumption signals is composed of a plurality of sub-signals.

6. A method of using The instantaneous fuel consumption displaying device for a vehicle according to claim 2, wherein each of the plurality of fuel consumption signals is composed of a plurality of sub-signals.

7. A method of using The instantaneous fuel consumption displaying device for a vehicle according to claim 3, wherein each of the plurality of fuel consumption signals is composed of a plurality of sub-signals.

8. A method of using The instantaneous fuel consumption displaying device for a vehicle according to claim 1, wherein with respect to information on a present amount of injected fuel, the instantaneous fuel consumption is calculated based on a distance traveled.

9. A method of using The instantaneous fuel consumption displaying device for a vehicle according to claim 2, wherein with respect to information on a present amount of injected fuel, the instantaneous fuel consumption is calculated based on a distance traveled.

10. A method of using The instantaneous fuel consumption displaying device for a vehicle according to claim 3, wherein with respect to information on a present amount of injected fuel, the instantaneous fuel consumption is calculated based on a distance traveled.

11. A method of using The instantaneous fuel consumption displaying device for a vehicle according to claim 5, wherein with respect to information on a present amount of injected fuel, the instantaneous fuel consumption is calculated based on a distance traveled.

12. A method of using The instantaneous fuel consumption displaying device for a vehicle according to claim 1, wherein in a front-back direction of a vehicle body of a motorcycle loaded with said engine, said injection controller is disposed in a rear of said engine, a meter provided with said display portion is disposed in front of said engine.

13. A method of using An instantaneous fuel consumption displaying device for a motorcycle comprising:

a fuel injector for injecting fuel into an engine in response to an injection pulse inputted thereto, said motorcycle having a front-back direction with said engine being mounted thereon and an injection controller being disposed in a rear of said engine with a meter provided with a display portion being disposed in front of said engine;

said injection controller supplies an injection pulse corresponding to an amount of injected fuel calculated based on an operational situation of said engine to said fuel injector, and forming information on the amount of injected fuel in accordance with the number of injection pulses supplied to said fuel injector;

said display portion including at least a vehicle speed display portion and an instantaneous fuel consumption display portion, said display portion being positioned in a forward portion of the motorcycle;

a display controller for calculating the instantaneous fuel consumption based on the information on the amount of injected fuel, and displaying information on the instantaneous fuel consumption thus calculated on the display portion, said display portion displays on the instantaneous fuel consumption display portion the information on the instantaneous fuel consumption in a digital manner and is disposed adjacent to a digital motorcycle speed displaying portion on said meter;

a communication line for transmitting the information on the amount of injected fuel from said injection controller to said display controller;

wherein said display controller for displaying instantaneous fuel consumption for a vehicle includes the information on the amount of injected fuel without interference from engine noise that creates a communication error in the communication line by providing a plurality of fuel consumption signals, the injection controller adds time information to the plurality of fuel consumption signals and sends out the resulting information regarding pulse width duration whenever the number of injection pulses becomes a value corresponding to a predetermined reference instantaneous injection amount, and said display controller, while receiving the plurality of fuel consumption signals in order, determines whether or not the fuel signal thus received is a predetermined signal, and when the plurality of fuel consumption signals are discriminated by a reference number, decides that the fuel for the reference instantaneous fuel injection amount is injected, to calculate the instantaneous fuel consumption, thereby displaying information on the instantaneous fuel consumption without interference from engine nose that would create a communication error;

wherein the information on the instantaneous fuel consumption is displayed for a time previously set on said display portion, wherein when it is not decided that the fuel for the reference instantaneous injection amount is injected within a period of time for sending of the information on the amount of injected fuel, instantaneous fuel consumption fail display is carried out instead of carrying out the instantaneous fuel consumption display, and wherein when it is not decided that the fuel for the reference instantaneous injection amount is injected at a time point of end of the period of time for sending of the information on the amount of injected fuel, the instantaneous fuel consumption fail display is carried out for a time corresponding to the period of time for sending of the information on the amount of injected fuel, and the period of time for sending of the information on the amount of injected fuel is set approximately equal to a vehicle speed fail display period of time information on which is displayed on said digital vehicle speed displaying portion.

14. A method of using The instantaneous fuel consumption displaying device for a motorcycle according to claim 13, wherein the plurality of fuel consumption signals are composed of digital data containing therein time information that is reset whenever the instantaneous fuel consumption is calculated, and the time information of the pieces of digital data is added to each piece of digital data based on a value of a counter which is incremented.

15. A method of using The instantaneous fuel consumption displaying device for a motorcycle according to claim 13, wherein whether or not the plurality of fuel consumption signals are discriminated by the reference number is determined in accordance with whether or not a value of a tentative decision counter which is updated whenever the fuel consumption signal is properly received reaches a predetermined number, and at a time point when the plurality of fuel consumption signals are properly received by the predetermined number, counting processing is ended by said tentative decision counter.

16. A method of using The instantaneous fuel consumption displaying device for a motorcycle according to claim 13, wherein each of the plurality of fuel consumption signals is composed of a plurality of sub-signals.

17. A method of using The instantaneous fuel consumption displaying device for a motorcycle according to claim 13, wherein with respect to information on a present amount of injected fuel, the instantaneous fuel consumption is calculated based on a distance traveled.

* * * * *